United States Patent [19]

Robertson

[11] Patent Number: 4,689,522

[45] Date of Patent: Aug. 25, 1987

[54] FLAT-PANEL, FULL-COLOR, ELECTROLUMINESCENT DISPLAY

[75] Inventor: James B. Robertson, Yorktown, Va.

[73] Assignee: The United States of America as represented by the Administator of the National Aeronautics and Space Administration, Washington, D.C.

[21] Appl. No.: 804,196

[22] Filed: Dec. 3, 1985

[51] Int. Cl.[4] ..... H05B 33/14; H05B 33/02

[52] U.S. Cl. ..... 313/506; 313/509; 313/505

[58] Field of Search ..... 313/506, 509, 494, 463, 313/500, 505; 445/33; 427/66

[56] References Cited

U.S. PATENT DOCUMENTS 2,925,532 2/1960 Larach .
3,015,747 1/1962 Rosenberg ..... 313/506 X
3,167,677 1/1965 Fremuth .
3,531,585 9/1920 Strain ..... 313/506 X
4,155,030 5/1979 Chang .
4,396,864 8/1983 Suntola et al. ..... 313/506

*Primary Examiner*—David K. Moore
*Assistant Examiner*—K. Wieder
*Attorney, Agent, or Firm*—George F. Helfrich; John R. Manning

[57] ABSTRACT

A full-color, flat-panel, matrix-addressed, electroluminescent display 10 is achieved using red, green and blue phosphors in two layers separated by layers of insulating material 16, 20, 24 and 30 and layers of row 22 and column 14 and 32 electrodes used to excite the phosphors when voltage is applied. One phosphor layer is all one color 18 while the second phosphor layer is composed of alternating, side-by-side stripes of a second color 26 and a third color 28. At each intersection of the row 22 and column 14 and 32 electrodes, a picture element is formed by the two side-by-side color phosphors 26 and 28 as they are superimposed over the single color 18 layer.

18 Claims, 4 Drawing Figures

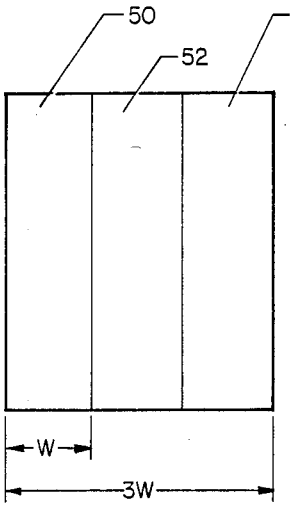
FIGURE 2
FIGURE 3
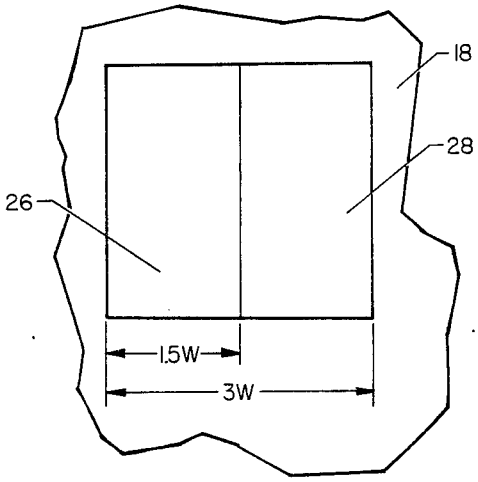
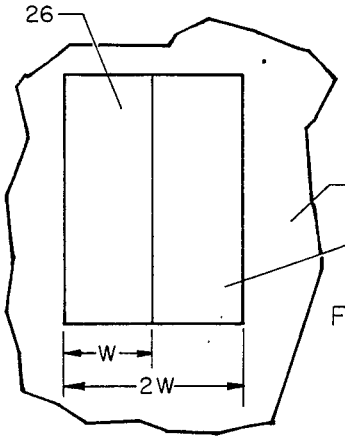
FIGURE 4

FLAT-PANEL, FULL-COLOR, ELECTROLUMINESCENT DISPLAY

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

Matrix-addressed, flat-panel displays are rapidly gaining acceptance as computer terminal displays and instrument displays in automobiles and aircraft cockpits. In order to compete with cathode ray tubes in more than limited applications, flat-panel displays must be offered in full color. Full-color displays require the use and control of the three primary colors; red, blue and green. Flat-panel displays are matrix-addressed, i.e., a set of row electrodes and a set of column electrodes with a picture element located at each intersection of row and column electrodes. Construction of a color display requires that red, green, and blue picture elements (dots) be superimposed or placed in close proximity and be small enough so that the human eye integrates rather than resolves the individual color dots.

To date, prior designs for full-color displays consist of the coplanar (single-layer) design or the stacked (threelayer) design. In the coplanar design, the three phosphors are placed side-by-side to form one picture element. This requires electrodes that are one-third the width of the picture element, which conflicts with the design goal of lower electrode resistance. The wider the electrode width, the lower the electrode resistance and the greater the brightness. However, as the brightness goes up, the picture resolution decreases as each picture element gets larger.

In the stacked design, the three color phosphors are placed one on top of the other to form one picture element. In thin-film electroluminescent displays, the phosphor layers and the electrode layers must be separated from each other by layers of insulating material, giving the stacked display a minimum of sixteen layers. The reflection and loss of transmission at each layer interface decreases the contrast ratio of the display. Furthermore, the stacked design has a set of row and a set of column electrodes that are separated by only one insulating layer, thereby creating undesirable capacitance.

Accordingly, an object of the present invention is a full-color, flat-panel, electroluminescent display capable of high brightness and high resolution.

A further object of the present invention is a flatpanel display design requiring a minimum of layers thereby increasing the contrast ratio.

A still further object of the present invention is a flat-panel display design whose layered structure decreases undesirable capacitance between row and column electrodes.

Other objects and advantages of this invention will become more apparent hereinafter in the specification and drawings.

BRIEF SUMMARY OF THE INVENTION

The invention is a full-color, flat-panel, matrix-addressed, electroluminescent display using red, green and blue phosphors in two layers separated by layers of insulating material and layers of row and column electrodes used to excite the phosphors. One phosphor layer is all one color while the second phosphor layer is alternating, side-by-side stripes of equal width of the other two colors. At each intersection of the row and column electrodes, a picture element is formed by the two side-by-side color phosphors as they are superimposed over the single color layer.

BRIEF SUMMARY OF THE DRAWINGS

FIG. 2 shows the side-by-side configuration of phosphor stripes in the prior art, coplanar design;

FIG. 3 shows the side-by-side configuration of two phosphor stripes superimposed over a single color phosphor layer required to form a brighter picture element according to the present invention; and FIG. 4 shows the side-by-side configuration of two phosphor stripes superimposed over a single color phosphor layer required to form a higher resolution picture element according to the present invention.

DETAILED DESCRIPTION OF THE INVENTION

Figure 1:
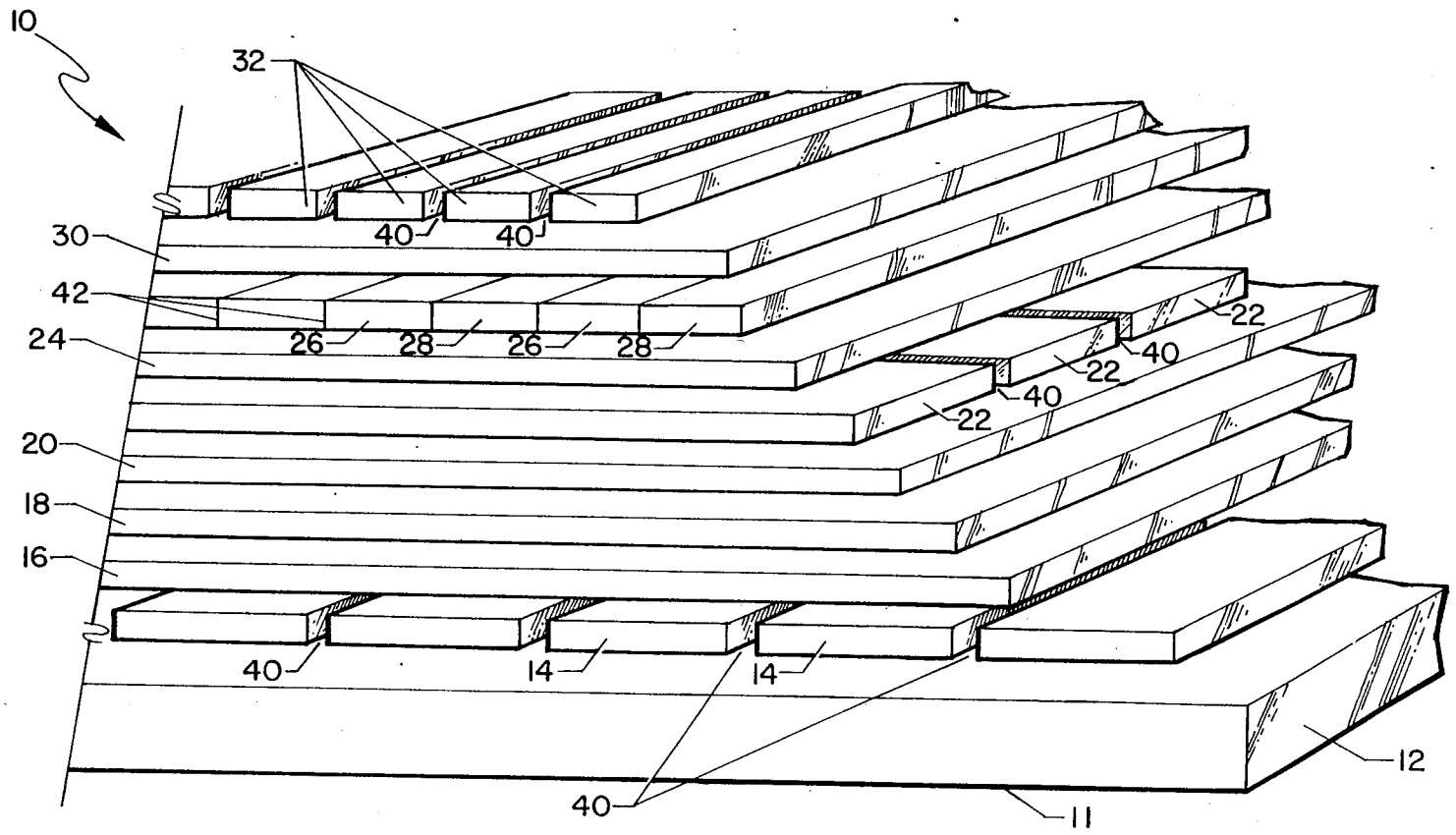
FIG. 1 is an exploded view of the flat-panel, full-color, electroluminescent display showing the layered structure according to the present invention.

Referring now more particularly to the preferred embodiment of the invention selected for illustration in FIG. 1, a flat-panel, full-color matrix-addressed, electroluminescent display according to the present invention and generally designated by reference numeral 10 is shown. The display 10 is constructed, using a thin-film deposition method such as evaporation or sputtering, by depositing onto a transparent glass substrate 12 the following materials in the following order: a coplanar layer of transparent front column electrodes 14, a first insulating layer 16, an electroluminescent phosphor layer of a first color 18, a second insulating layer 20, a coplanar layer of transparent row electrodes 22 oriented perpendicular to front column electrodes 1, a third insulating layer 24, a coplanar layer of alternating side-by-side stripes of electroluminescent phosphor of a second color 26, and a third color 28 oriented parallel to front column electrodes 14, a fourth insulating layer 30 and a coplanar layer of rear column electrodes 32 oriented parallel to phosphor stripes 26 and 28. A glass seal (not shown) may be added at this point, but is not required. Front column electrodes 14, row electrodes 22 and rear column electrodes 32 are isolated from adjoining electrodes within each respective layer by a small gap 40 between each electrode Gap 40 need not be the same throughout the display, however, this will be assumed for ease of discussion. Gap 40 need only be wide enough to prevent arcing between electrodes.

Transparent front column electrodes 14 and transparent row electrodes 22 are typically indium tin oxide approximately 2000 Angstrom (Å) thick. The thickness should be sufficient to keep the resistance low thereby allowing the electrodes 14 and 22 to act as conductors. Note, however, as the thickness of these electrodes increases, their transparency decreases. Rear column electrodes 32 need not be transparent, although they may be, as display 10 is viewed through the glass substrate layer 12 from the substrate side 11 of display 10. Thus, electrodes 32 are typically aluminum or some other reflective material approximately 1000Å thick. Since electrodes 32 need only be thick enough to conduct, the upper limit on their thickness is not critical. Insulating layers 16, 20, 24 and 30 are typically silicon oxide or silicon nitride and approximately 1000–2000Å thick. Thicknesses should be sufficient to prevent arcing or breakdown between layers. The thickness of the color phosphor (layer 18 and stripes 26 and 28) range from 4000–5000Å. As the thickness of the phosphors increases so does the voltage required to develop the necessary electric field to excite the phosphors. The layers of material could also be deposited on glass substrate layer 12 in reverse order thereby placing phosphor stripes 26 and 28 in front of phosphor layer 18 when viewing through glass substrate layer 12 from the substrate side 11 of display 10.

Every rear column electrode 32 is centered and superimposed directly over a phosphor stripe 26 or 28. Each small gap 40 between rear column electrodes 32 is centered and superimposed directly over a phosphor stripe boundary 42. Thus, the distance between centers of phosphor stripes 26 and 28 is equal to the distance between centers of rear column electrodes 32.

Every front column electrode 14 is centered and superimposed directly over two adjoining phosphor stripes 26 and 28. Each small gap 40 between front column electrodes 14 is centered and superimposed directly over every second phosphor stripe boundary 42. Thus, the distance between centers of phosphor stripes 26 and 28 is one-half the distance between centers of front column electrodes 14. Front column electrodes 14 and row electrodes 22 are of equal width thereby forming square picture elements or pixels when their intersections overlap phosphor stripes 26 and 28 and rear column electrodes 32.

The invention is not limited to the orientation relationships forming square picture elements as described above. The shape of the picture elements is determined by varying the widths and orientations of electrodes 14, 22 and 32 and phosphor stripes 26 and 28. The only requirements are that (1) front column electrodes 14 must be oriented at an angle greater than 0° with respect to row electrodes 22 and, (2) that front column electrodes 14 must never be perpendicular to rear column electrodes 32.

Full-color is achieved through use of electroluminescent phosphors in the three primary colors: red, blue and green. In the preferred embodiment, phosphor layer of a first color 18 comprises blue phosphor, phosphor stripe of a second color 26 comprises red phosphor and phosphor stripe of a third color 28 comprises green phosphor. Combinations of the three pirmary colors is not limited to this arrangement. However, differing combinations will affect the brightness of the display as will be explained herein. The best available red, green and blue phosphors for thin-film electroluminescence differ from each other in maximum brightness with the green phosphor presently being nearly ten times brighter than the blue. Thus, in color displays, the brightness of the display is limited by the brightness of the weakest color phosphor.

The side-by-side configuration of electroluminescent phosphor stripes in the prior art, coplanar design is shown in FIG. 2. Typically, phosphor stripes 50, 52 and 54 comprise red, green and blue phosphor in any order. Each stripe is of width W and each picture element is a square of 3W on a side as it is formed at the intersection of the row and column electrodes (not shown). Assuming the column electrodes are oriented parallel to stripes 50, 52 and 54, column electrodes and phosphor width are limited to one-third of the picture element area thereby limiting the brightness.

In the new design, as shown in FIG. 3, now a square picture element of 3W on a side comprises two layers; phosphor stripes 26 and 28 of width 1.5W superimposed over phosphor layer 18. (Once again, row and column electrodes are not shown for clarity.) The area of phosphor layer 18 is twice the area of either phosphor stripe 26 or 28, Thus, if the dimmest of the phosphors (blue) is used for phosphor layer 18, the display can be twice as bright as when all colors are of equal area as in the case of prior designs. Furthermore, phosphor stripes 26 and 28 are now each fifty percent wider than the stripes shown in FIG. 2, thereby providing for greater electrode width, i.e., lower electrode resistance, while achieving the same resolution (lines/inch) as the coplanar design in FIG. 2.

The new, two phosphor layer design can also be used to increase picture resolution over previous designs while maintaining a higher brightness. In FIG. 4, the picture element has been reduced to a square of 2W on a side. Since only two electrode widths per picture element are required for stripes 26 and 28, a fifty percent increase in resolution is achieved using the same electrode width as in the previous coplanar design shown in FIG. 2. Brightness levels are still high as the area of the dimmest phosphor (blue) in layer 18 is still twice the area of either phosphor stripe 26 or 28.

The new, two phosphor layer design also makes a substantial improvement in contrast ratio over the stacked, three-layer design. The new design requires a minimum of only ten layers, including the substrate 12. This is a thirty-seven percent decrease in the minimum number of layers (16 including substrate) required by the stacked design. Fewer layers should also decrease manufacturing costs. Furthermore, in the new design, row and column are separated by a minimum of two insulating layers and one phosphor layer, thereby decreasing unwanted capacitance between row and column electrodes normally prevalent in the stacked design where row and column electrodes are separated by only one insulating layer.

In operation, the display 10 is addressed (i.e., information is caused to be made visible in the display) by applying sufficient voltage (ac or dc) between selected column 14 and 32 and row 22 electrodes. This places an electric field across the phosphor located between the overlap of the selected column and row electrodes, causing the phosphor to emit light at this location. These and other matrix-addressed displays can be addressed "line-at-a-time" (row or column) fashion in rapid enough sequence to display information at standard TV frame rates.

Alternate forms of the invention include rear column electrodes of reflective, transparent or light absorbing material. The design can also be used with or without insulating layers between electrodes and the display material, although use of insulating layers prolongs the life of the display. Also, the electroluminescent phosphor need not be deposited as continous stripes as described herein.

The advantages of the present invention are numerous. It will find great utility as a full-color, flat-panel display capable of replacing cathode ray tubes (CRT) in a variety of applications ranging from computer terminal displays and instrument displays in automobiles to aircraft cockpit displays. The small size will permit full-color display use in areas where CRTs could not previously be used because of size constraints. The new design will provide for higher brightness, better contrast ratio and higher resolution than available in previous full-color, flat-panel, electroluminescent displays. This design can be used for any flat-panel display medium which is transparent, such as thin-film electroluminescent phosphors, liquid crystals or light emitting diodes.

Thus, although the invention has been described relative to specific embodiments thereof, it is not so limited and numerous variations and modifications thereof will be readily apparent to those skilled in the art in the light of the above teaching. It is therefore to be understood that within the scope of the appended claims the invention may be practiced otherwise than as specifically described.

What is claimed as new and desired to be secured by Letters Patent of the United States is:

1. A full-color, flat-panel, matrix-addressed, electroluminescent display comprising at least one transparent glass substrate onto which the following materials are deposited:

a coplanar group of transparent front column electrodes;

an insulating means;

electroluminescent phosphor of a first color;

another insulating means;

a coplanar group of transparent row electrodes oriented relative to said front column electrodes at an angle greater than 0° thereby forming an area of overlap upon intersection;

another insulating means;

a coplanar group of alternating side-by-side deposits of electroluminescent phosphor of a second color and a third color;

another insulating means; and a coplanar group of rear column electrodes whereby a picture element is formed whenever a said area of overlap is superimposed over said alternating side-by-side deposits as said side-by-side deposits are superimposed over said phosphor of a first color.

2. A display according to claim 1 wherein each of said front column electrodes, each of said rear column electrodes and each of said row electrodes are separated from each other in their respective said coplanar groups by a small gap.

3. A display according to claim 2 wherein said front column electrodes and said row electrodes are of equal width;

said phosphor deposits of a second color and a third color are stripes of equal width and said rear column electrodes are of equal width.

4. A display according to claim 3 wherein said front column electrodes are oriented perpendicular to said row electrodes, said phosphor stripes are oriented parallel to said front column electrodes and said rear column electrodes are oriented parallel to said phosphor stripes.

5. A display according to claim 4 wherein the distance between centers of said phosphor stripes equals one-half the distance between centers of said front column electrodes.

6. A display according to claim 4 wherein the distance between centers of said phosphor stripes equals the distance between centers of said rear column electrodes.

7. A display according to claim 4 wherein the width of each one of said rear column electrodes is centered and superimposed directly over the width of each one of said phosphor stripes whereby said small gap between each of said rear column electrodes is centered and superimposed directly over the boundary between each of said phosphor stripes.

8. A display according to claim 4 wherein the width of each one of said front column electrodes is centered and superimposed directly over the combined width of each set of said phosphor stripes of a second color and a third color whereby said small gap between each of said front column electrodes is centered and superimposed directly over every second boundary between each of said phosphor stripes.

9. A display according to claim 4 wherein said phosphor or a first color and said phosphor deposits of a second color and a third color are each different color phosphors.

10. A display according to claim 9 wherein said different color phosphors comprise red, green and blue phosphors.

11. A display according to claim 10 wherein the maximum brightness of said display is achieved when said first color comprises blue phosphor.

12. A full-color, flat-panel, matrix-addressed, electroluminescent display comprising a thin-film layered structure, said structure having a first layer of a first distinct color phosphor superimposed over a second layer of second and third distinct color phosphors laid side-by-side in alternating stripes to form full-color picture elements.

13. A display according to claim 12 wherein said stripes are continuous.

14. A method of achieving full-color on a flat-panel, matrix-addressed, electroluminescent display comprising the steps of:

constructing a thin-film layered structure on a substrate means using one layer of color means of one color separated from another layer of color means of alternating other colors by layers of insulating means and layers of row and column electrode means;

positioning said row and column electrode means to intersect at an angle thereby forming an area of overlap at each intersection whereby said area of overlap when superimposed over said layers of color means forms a picture element; and applying a voltage to selected said row and column electrode means for the purpose of exciting said color means whereby said picture element achieves full-color.

15. A method according to claim 14 wherein the step of constructing is accomplished by depositing the two layers of color means, layers of insulating means and layers of row and column electrode means on the substrate means using a thin-film deposition method.

16. A method according to claim 14 wherein the step of coloring constructing is accomplished using colors blue, red and green.

17. A method according to claim 14 wherein the step of positioning is accomplished by orienting said row and column electrode means to intersect at right angles.

18. A method according to claim 15 wherein said depositing the two layers of color means provides color means in the range of 4000–5000Å thick and wherein said depositing the layers of insulating means and layers of row and column electrode means provides insulating means and row and column electrode means in the range of 1000–2000Å thick.

* * * * *